United States Patent [19]

Severijns et al.

[11] 4,296,609

[45] Oct. 27, 1981

[54] $^3$HE-$^4$HE REFRIGERATOR

[75] Inventors: Adrianus P. Severijns; Frans A. Staas, both of Eindhoven, Netherlands

[73] Assignee: U.S. Philips Corporation, New York, N.Y.

[21] Appl. No.: 132,468

[22] Filed: Mar. 19, 1980

[30] Foreign Application Priority Data

Mar. 29, 1979 [NL] Netherlands ..... 7902438

[51] Int. Cl.$^3$ ..... F25B 19/00

[52] U.S. Cl. ..... 62/514 R

[58] Field of Search ..... 62/467, 514 R

[56] References Cited

U.S. PATENT DOCUMENTS 3,835,662 9/1974 Staas et al. ..... 62/467

OTHER PUBLICATIONS

Staas, F. A. et al.: "Vorticity in He II and its Application in a Cooling Device", *Cryogenics,* Dec. 1969, pp. 422–426.

"An Improved Version of the He$^3$–He$^4$ Refrigerator Through Which He$^4$ is Circulated." *Cryogenics,* Jan. 1974, pp. 53, 54.

*Primary Examiner*—Ronald C. Capossela

*Attorney, Agent, or Firm*—Thomas A. Briody; William J. Streeter; Rolf E. Schneider

[57] ABSTRACT

$^3$He-$^4$He refrigerator in which superfluid $^4$He is circulated by a thermomechanical pumping device which is based on the fountain pump effect and which is constructed from several series-arranged fountain pumps.

3 Claims, 1 Drawing Figure

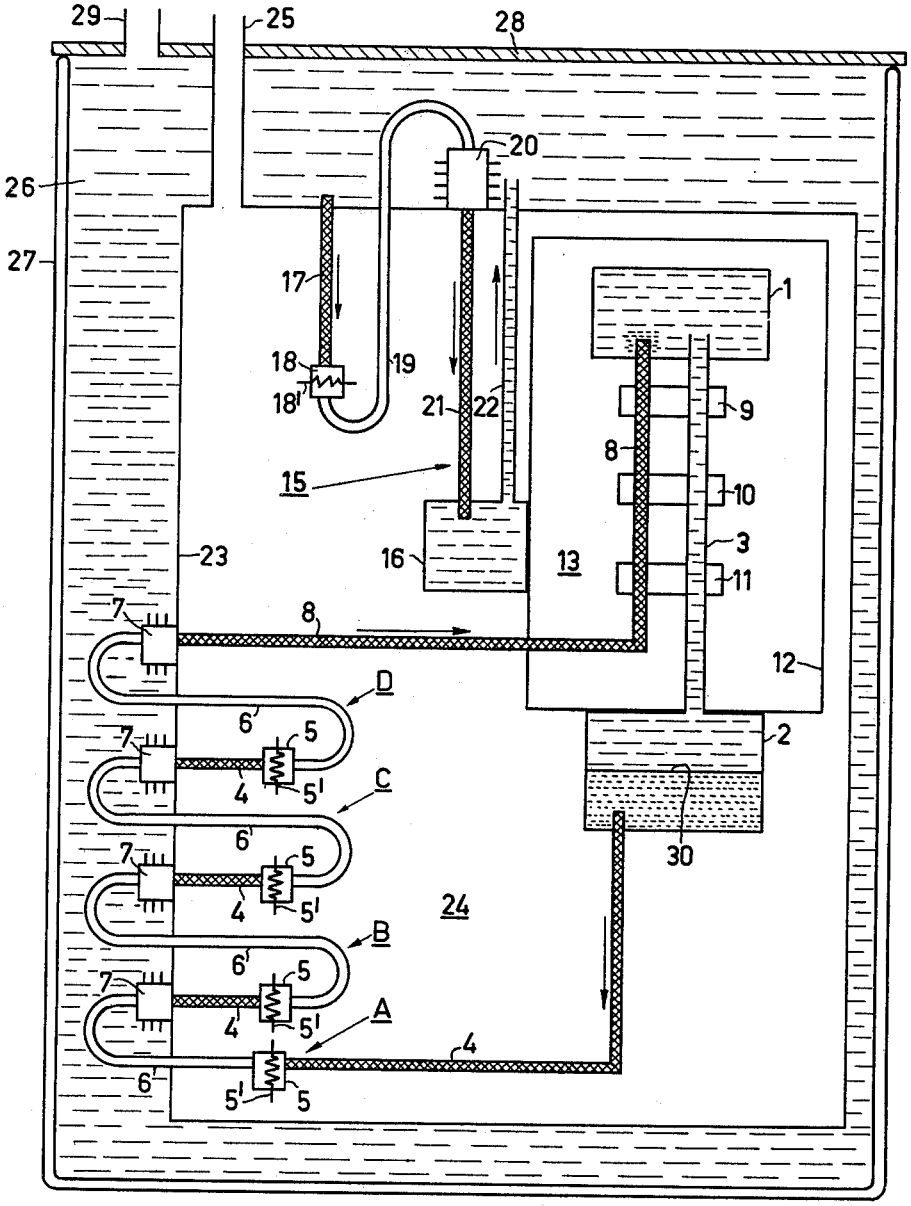
29
25
28
20
26
27
17
1
18
19
18'
21
22
9
8
15
10
3
23
16
13
11
7
8
12
D
6'
5
2
7
4
5'
C
6'
5
30
7
4
5'
24
B
6'
5
7
4'
5'
A
4
6'
5'
5

$^3$HE-$^4$HE REFRIGERATOR

This invention relates to a $^3$He-$^4$He refrigerator for very low temperatures, comprising a mixing chamber for mixing liquid concentrated $^3$He and superfluid, $^4$He, a segregating chamber which is accommodated at a lower level than the mixing chamber for separating a diluted $^3$He phase and a concentrated $^3$He phase, a connection duct between the mixing chamber and the upper part of the segregating chamber, and a thermomechanical pumping device based on the fountain pump effect for circulating superfluid $^4$He comprising a first superleak which communicates with the lower part of the segregating chamber and serves to withdraw superfluid $^4$He from the segregating chamber and a second superleak which opens into the mixing chamber for injecting superfluid $^4$He into the mixing chamber.

A refrigerator of this type is known from the article "An improved version of the $^3$He-$^4$He refrigerator through which $^4$He is circulated" (Cryogenics, January 1974, pp. 53-54).

During operation a phase separation takes place in the segregating chamber, that is to say, a separation between a $^3$He-rich phase (concentrated $^3$He) and a $^3$He-poor phase (diluted $^3$He, or $^3$He dissolved in $^4$He).

Since the concentrated $^3$He has a smaller specific gravity than the diluted $^3$He, the concentrated $^3$He floats on the diluted $^3$He and automatically fills the connection duct and the mixing chamber.

The thermomechanical pumping device of the known refrigerator withdraws superfluid $^4$He from the diluted $^3$He in the segregating chamber and injects this into the mixing chamber. A part of the concentrated $^3$He present there dissolves in the superfluid $^4$He, which provides a cooling effect by the withdrawal of the required mixing heat from the surroundings. The diluted $^3$He formed falls through the concentrated $^3$He in the mixing chamber and through the connection duct to the segregating chamber where segregation takes place at the area of the phase separation face. The evolved heat is removed via an exhausted $^3$He bath.

The thermomechanical pumping device of this known refrigerator consists of a single fountain pump. Viewed in the direction from the inlet side to the outlet side a fountain pump consists of a series arrangement of a superleak, a chamber with a heating device, a narrow duct and a cooler.

A superleak has the property that it passes superfluid $^4$He but does not pass normal $^4$He. Thus a superleak does not pass entropy.

By heating the fountain pump chamber, the superfluid $^4$He flows from the segregating chamber to pump the chamber on the basis of the fountain effect as a result of the produced temperature difference. As a result of the heating of the pump chamber, the superfluid $^4$He is partly converted into normal $^4$He. In the narrow duct where the normal component exceeds its critical speed so that turbulence occurs, the superfluid component is dragged along by said normal component to the cooler which is kept at a temperature lower than the temperature of the pump chamber. In the cooler the normal component is converted again into the superfluid component. The superfluid component then flows from the cooler via a second superleak, an injection superleak, to the mixing chamber.

In order to realize lower temperatures in the mixing chamber in the known refrigerator, the $^4$He circulation (the number of moles of $^4$He which passes a cross-section per second) must be increased. This is associated with a larger heat evolution per unit of time upon segregation in the segregating chamber. With the given exhausted $^3$He bath for taking up the released segregating heat this means that the temperature in the segregating chamber rises. The osmotic pressure of the diluted $^3$He in the segregating chamber then increases in such manner that it is no longer possible for the fountain pump to circulate superfluid $^4$He.

It is an object of the present invention to provide an improved $^3$He-$^4$He refrigerator of this type in which circulation of superfluid $^4$He is possible also at the higher temperatures of the segregating chamber.

In order to realize this end, the $^3$He-$^4$He refrigerator according to the invention is characterized in that the thermomechanical pumping device is constructed from several series-arranged fountain pumps.

It is extremely surprising that due to such series arrangement of identical fountain pumps a refrigerator is obtained having a large $^4$He circulation in which high osmotic pressures are overcome.

In a series arrangement of conventional mechanical pumps the construction of said pumps mutually should be matched so that the suction pressure of one pump corresponds to the pressure of the preceding pump, but this is not necessary in the present case in which in fact an addition takes place of the pump pressures provided by the individual fountain pumps from the series arrangement.

In order to reduce heat leak from the segregating chamber at higher temperature to the mixing chamber at lower temperature, a favourable embodiment of the $^3$He-$^4$He refrigerator according to the invention is characterized in that the connection duct is in heat exchanging contact with the second superleak.

In the known refrigerator the segregating chamber is in heat exchanging contact with an exhausted $^3$He bath, as a cooling device which absorbs the released heat of segregation.

Exhaustion of said bath is done by means of a mechanical pumping device which is at room temperature and is incorporated in a hermetically sealed $^3$He circulation system. This makes the refrigerator complicated and expensive.

In order to avoid these disadvantages a further favourable embodiment of the $^3$He-$^4$He refrigerator according to the invention is characterized in that the cooling device consists of a $^4$He vortex refrigerator.

The larger $^4$He circulation in the refrigerator according to the invention is associated, as already stated, with a larger heat evolution per time unit upon segregation in the segregating chamber. The vortex refrigerator, accommodated in the lower temperature part of the present refrigerator, now provides the required cooling capacity in a structurally simple manner.

$^4$He vortex refrigerators are known per se from the article "Vorticity in He-II and its application in a cooling device" (Cryogenics, December 1969, pp. 422–426).

The invention furthermore relates to a thermal mechanical pumping device which is based on the fountain pump effect for transporting superfluid $^4$He, characterized by a series arrangement of several fountain pumps. Such a pumping device having series-arranged fountain pumps is also suitable for use in the above-mentioned vortex refrigerator, as well as in $^3$He-$^4$He refrigerators having both $^3$He circulation and $^4$He circulation as described in U.S. Pat. No. 3,835,662.

The invention will now be described in greater detail with reference to the accompanying drawing in which an embodiment of the present $He^3$-$He^4$ refrigerator is shown diagrammatically.

Reference numerals 1 and 2 denote two chambers accommodated at different levels. The upper chamber 1 is a mixing chamber and the lower chamber 2 is a segregating chamber, the chambers communicating with each other via a connection duct 3. Between the segregating chamber 2 and the mixing chamber 1 is furthermore present a thermomechanical pumping device consisting of four series-arranged $^4$He fountain pumps A, B, C and D. Each fountain pump consists of a series arrangement of a superleak 4, a chamber 5 having a heating device 5', a capillary 6 and a cooler 7. Superleak 4 of fountain pump A opens into the lower portion of the segregating chamber 2, while an injection superleak 8 is connected to one end to fountain pump D and at the other end opens into the lower part of the mixing chamber 1.

Superleak 8 is in heat exchanging contact with connection duct 3 by means of heat exchangers 9, 10 and 11.

The mixing chamber 1, connection duct 3, a part of the upper superleak 8 and the heat exchangers 9, 10 and 11 are accommodated in a radiation screen 12 of heat conducting material, for example copper. The space 13 within the radiation screen 12 is evacuated. Segregating chamber 2 is connected to radiation screen 12 in a heat conducting manner and is cooled via said screen 12 by a vortex refrigerator 15. The vortex refrigerator 15 comprises a reservoir 16 which is in heat exchanging contact with the radiation screen 12 and to which superfluid $^4$He can be supplied via a fountain pump consisting of a superleak 17, a chamber 18 having a heating device 18', a capillary 19 and a cooler 20, and via an injection superleak 21 opening into the reservoir 16. The removal of $^4$He from reservoir 16 occurs via a capillary 22.

The colder part of the present refrigerator is accommodated in a vacuum jacket 23. The space 24 within the vacuum jacket 23 can be evacuated via a duct 25.

The vacuum jacket 23 is surrounded by a liquid $^4$He bath 26 within a cryostat 27 having a cover 28. The $^4$He bath 26 is kept at a temperature of, for example, 1.2 K. by exhausting $^4$He vapour via a duct 29.

The four coolers 7 of the fountain pump A, B, C and D and the cooler 20 of the vortex refrigerator 15 are situated in the $^4$He bath 26 for direct heat exchange therewith. Superleak 17 and capillary 22 of the vortex refrigerator 15 are in open communication with the $^4$He bath 26.

The operation of the present refrigerator is as follows.

The mixing chamber 1, the connection duct 3 and the segregating chamber 2 are filled with a $^3$He-$^4$He mixture in such a ratio of the components $^3$He and $^4$He that upon cooling the segregating chamber 2 by the vortex refrigerator 15 (to a temperature of, for example, 0.8 K.) a phase separation (interface 30) occurs in the segregating chamber 2. As a result of the difference in density between the two phases (concentrated $^3$He has a lower specific gravity than diluted $^3$He) the connection duct 3 and the mixing chamber 1 are filled automatically with concentrated $^3$He. Thus concentrated $^3$He floats on the diluted $^3$He which is present in the lower part of the segregating chamber 2.

After having filled the superleaks 4 of the fountain pumps A, B, C and D and the injection superleak 8 with $^4$He, the $^4$He circulation is started by switching on the four heating devices 5' (for example electric heating elements). Superfluid $^4$He is withdrawn from the diluted $^3$He in the segregating chamber 2 via the lower superleak 4 and is injected into the mixing chamber 1 via the upper superleak 8. The injected superfluid $^4$He dilutes the concentrated $^3$He present in the mixing chamber 1. This is associated with cold production. The formed diluted $^3$He which has a higher specific gravity than concentrated $^3$He, falls via connection duct 3 through the concentrated $^3$He to the segregating chamber 2. At the interface 30 segregation occurs, concentrated $^3$He being formed which flows to the mixing chamber 1 via connection duct 3 and replenishes the deficiency of concentrated $^3$He arising from the dilution. From the diluted phase, superfluid $^4$He is again withdrawn by the lowermost superleak 4. The heat released upon segregation at the area of the interface 30 is absorbed by the $^4$He bath in reservoir 16 of the vortex refrigerator 15.

The operation of each of the fountain pumps A, B, C and D is identical to that described above for a refrigerator having a single fountain pump. However, it is most surprising that in the present case of sufficiently high fountain pressure is generated so that the $^4$He is circulated against a very high osmotic pressure in the segregating chamber 2.

The operation of the vortex refrigerator 15 is as follows. Via superleak 17, with heating device 18' switched on, superfluid $^4$He is withdrawn from the $^4$He bath 26 by the fountain pump 17-20 and supplied to reservoir 16 via superleak 21. By absorption of the heat from segregating chamber 2 the normal $^4$He in reservoir 16 partly changes into superfluid $^4$He. Since the speed of the superfluid $^4$He in capillary 22 is so large that vortices are created, the normal $^4$He is dragged along from reservoir 16 to the $^4$He bath 26.

Via the heat exchangers 9, 10 and 11 it is achieved that the leak via superleak 8 to the mixing chamber 1 is reduced.

What is claimed is:

1. A $^3$He-$^4$He refrigerator which comprises a mixing chamber for mixing liquid concentrated $^3$He and superfluid $^4$He; a segregating chamber accommodated at a lower level than the mixing chamber for separating a diluted $^3$He phase and a concentrated $^3$He phase; a connection duct between the mixing chamber and the upper part of the segregating chamber; and a thermomechanical pumping device based on the fountain pump effect for circulating superfluid $^4$He including a first superleak communicating with the lower part of the segregating chamber for withdrawing superfluid $^4$He from the segregating chamber and a second superleak opening into the mixing chamber for injecting superfluid $^4$He into the mixing chamber, said thermomechanical pumping device being constituted by a plurality of series-arranged fountain pumps.

2. A $^3$He-$^4$He refrigerator according to claim 1, in which the connection duct is in heat-exchanging contact with the second superleak.

3. A $^3$He-$^4$He refrigerator according to claim 1 or 2, in which the segregating chamber is in heat-exchanging contact with a $^4$He vortex refrigerator for absorbing heat released upon segregation.

* * * * *